US012420130B2

(12) United States Patent
Shelton

(10) Patent No.: US 12,420,130 B2
(45) Date of Patent: Sep. 23, 2025

(54) SUPPORTIVE WEIGHTED BLOCK FOR YOGA

(71) Applicant: Loa Movement LLC, Durham, NC (US)

(72) Inventor: Lauren H. Shelton, Durham, NC (US)

(73) Assignee: Loa Movement LLC, Durham, NC (US)

( * ) Notice: Subject to any disclaimer, the term of this patent is extended or adjusted under 35 U.S.C. 154(b) by 174 days.

(21) Appl. No.: 18/330,991

(22) Filed: Jun. 7, 2023

(65) Prior Publication Data

US 2024/0408429 A1 Dec. 12, 2024

(51) Int. Cl.
*A63B 21/00* (2006.01)

(52) U.S. Cl.
CPC .... *A63B 21/00047* (2013.01); *A63B 21/4035* (2015.10)

(58) Field of Classification Search
CPC ..... A63B 21/00047; A63B 21/072; A63B 21/4035
See application file for complete search history.

(56) References Cited

U.S. PATENT DOCUMENTS

| | | | | |
|---|---|---|---|---|
| 9,925,408 | B1 * | 3/2018 | Murdock | A63B 21/4043 |
| 10,350,449 | B2 * | 7/2019 | Abrahams | A63B 71/0036 |
| 10,413,772 | B2 * | 9/2019 | Zachariadis | A63B 21/4043 |
| 11,717,717 | B1 * | 8/2023 | Polovin | A63B 23/1236 482/148 |
| 2007/0167301 | A1 * | 7/2007 | Evans | A63B 21/00047 482/148 |
| 2009/0023563 | A1 * | 1/2009 | Liang | A63B 21/072 482/106 |
| 2013/0274078 | A1 * | 10/2013 | Andrews | A63B 23/1236 482/141 |
| 2015/0258363 | A1 * | 9/2015 | Kampinski | A63B 21/00047 482/139 |
| 2018/0272180 | A1 * | 9/2018 | Abrahams | A63B 21/4037 |
| 2024/0082626 | A1 * | 3/2024 | Kocott | A63B 23/0458 |

* cited by examiner

*Primary Examiner* — Joshua Lee
(74) *Attorney, Agent, or Firm* — Wood IP, LLC; Theodore A. Wood

(57) ABSTRACT

Provided is a weighted block including a hexahedron shaped block body having a cavity, a top opening to the cavity, a bottom wall opposite to the top opening, a front wall opposite to a back wall, and a left wall opposite to a right wall. The bottom, front, back, right, and left walls interconnected and surrounding the cavity to form the hexahedron shaped block body. A rod inside the cavity connects the left and right walls. The cavity has a depth measured from the top opening to the bottom wall, a length measured from left wall to the right wall, and a width measured from the front wall to the back wall.

22 Claims, 9 Drawing Sheets

SUPPORTIVE WEIGHTED BLOCK FOR YOGA

TECHNICAL FIELD

The present disclosure relates generally to a weighted block that could be used as a weight and as a support during yoga exercises and methods of making and using the same.

BACKGROUND

At a high level, yoga is generally associated with physical balance, meditation, breathing, etc. However, many yoga practitioners, and even individuals with no personal experience of yoga, view yoga with a much deeper meaning. These individuals may view yoga, for example, as being a higher version of health. Yoga is also widely viewed as forming a mind-body connection. There are meditative aspects to this mind-body connection that can profoundly impact mental health, which may explain the depth many practitioners experience. Additionally, practitioners often notice changes in their stress levels, and partake in techniques to better control their breathing.

Unfortunately, there are also misconceptions about Yoga. For example, people frequently equate yoga with injury prevention. When discussing injury prevention measures, people often refer to the number of times per week they practice yoga. However, in many cases, practicing yoga may actually contribute to injury and pain. More specifically, commonly practiced yoga poses may actually cause various overuse injuries and muscle imbalances due to its repetitive nature.

When considering the gentle, low impact, and restorative nature of yoga, it may seem counterintuitive to think that yoga can cause pain. Under close analysis, however, some yoga poses present a greater risk of muscle injury and pain than others. Traditionally, there are very few props for yoga (e.g., resistance bands, weighted props etc.), except for foam and/or cork yoga blocks used for alignment purposes. As generally appreciated in other forms of movement, a prop can be an excellent aid to enhance an exercise and target specific muscles.

For example, a foam block could be used as a balancing point to create alignment if someone is attempting to round their back to touch the ground during a yoga balancing pose. In a triangle pose, for example, a yoga block might be used similarly as placement for one's hand to prevent misalignment by reaching down for the floor, or to shorten the distance between the hand and floor for lack of hip mobility. Thus, yoga blocks are used in different ways and in different poses, to regain and maintain alignment.

For example, in Vinyasa yoga (most widely practiced in the US) common poses such as Down Dog and Low Plank (known as Chaturanga) require immense muscle strength to execute properly, especially Deltoid and Pectoralis strength. Alternately, muscles such as the Rhomboids, Middle Trapezius, and Rotator Cuff, are virtually untargeted in yoga, causing an imbalance. Even worse, the muscles on the back side of the body are not only weak, but yoga places a huge emphasis on stretching and increasing the flexibility of these muscles. Over time, this imbalance between a strong anterior chain (front body), and weak and lengthened posterior chain (back body) creates poor movement patterns and can often result in injury. Currently there are no yoga poses or yoga props that will correct these posterior chain muscle deficiencies.

Another muscle commonly injured in yoga is the Hamstring, typically experienced by people that do lots of yoga for flexibility purposes. The two most common poses are the Down Dog and the Forward Fold pose, both of which significantly stretch and lengthen the hamstrings. Due to the nature of yoga and props, and in relation to the discussion above, there are no poses that strengthen the hamstrings. Thus, after consistently practicing yoga for months or years, where most of the poses are focused on stretching a weakened hamstring muscle, injury can often occur at the proximal hamstring attachment on the ischial tuberosity of the pelvis.

Dumbbells, and other types of weights can be effective tools for strengthening the Hamstrings, Rhomboids, Middle Trapezius, Rotator Cuff, and other weakened or underdeveloped muscles groups. Most yoga studios, however, generally avoid displaying dumbbells because of aesthetic reasons. That is, the appearance or display of sets of dumbbells can disrupt or destroy the mind body aesthetic of yoga studios. Even yoga studios that occasionally use dumbbells during classes rarely display dumbbells in the studio. Instead, the dumbbells are usually hidden away in closets or storage bins.

Traditional yoga blocks enhance the aesthetic vibe of yoga studios, but they are not heavy enough to provide muscle strengthening to the back body. Additionally, traditional yoga blocks lack handles, and other practical physical features that would allow them to be easily picked up, if they were to be of heavier weight. Thus, yoga blocks can be awkward and ineffective to use to perform strengthening exercises (e.g., rowing motions, pulling motions etc.), which is necessary to target the back body.

SUMMARY

Given the aforementioned deficiencies, what is needed, therefore, is a solution for performing yoga exercises that could also be used for strength training, from a physical therapy health perspective, without disrupting the mind body aesthetic vibe associated with yoga studios. What is also needed is a solution that can be used for balancing and/or alignment when performing Triangles, Half Moons, Warrior 3's, Eagles, and other common yoga poses.

Under certain circumstances, an embodiment of the present disclosure includes a weighted block with a hexahedron shaped block body having a cavity, a top opening to the cavity, and a bottom wall opposite to the top opening. The block also includes a front wall opposite to a back wall, and a left wall opposite to a right wall. The bottom, front, back, right, and left walls are interconnected and surround the cavity to form the hexahedron shaped block body. The block body includes a rod inside the cavity connecting the left and right walls. The cavity has a depth measured from the top opening to the bottom wall, a length measured from left wall to the right wall, and a width measured from the front wall to the back wall. The block body maintains its integrity when a weight or force is applied to the front, back, right, left walls, or the rod when its respective opposite wall is positioned against an immobile surface.

The embodiments provide a weighted block that can function both as a support for body weight and a weight for strength training during a yoga exercise. The weighted block can be used to allow a yoga participant to move in and out of poses without picking up and setting down weights. In one embodiment, the weighted block has a hexahedron shaped block body including a cavity and a handle inside the cavity. These features allow the block to be used as a weight during physical therapy and strength training. The block additionally has the physical integrity to be used as a support for body weight during yoga poses.

Additional features, modes of operations, advantages, and other aspects of various embodiments are described below with reference to the accompanying drawings. It is noted that the present disclosure is not limited to the specific embodiments described herein. These embodiments are presented for illustrative purposes only. Additional embodiments, or modifications of the embodiments disclosed, will be readily apparent to persons skilled in the relevant art(s) based on the teachings provided.

The figures are not necessarily to scale and some features may be exaggerated or minimized, such as to show details of particular components. In some instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure.

DETAILED DESCRIPTION

As required, detailed embodiments of the present disclosure are disclosed herein. The disclosed embodiments are merely examples that may be embodied in various and alternative forms, and combinations thereof. As used herein, for example, "exemplary," and similar terms, refer expansively to embodiments that serve as an illustration, specimen, model or pattern.

The following description is presented to enable any person skilled in the art to make and use the present disclosure and is provided in the context of a particular application and its requirements. Various modifications to the disclosed embodiments will be readily apparent to those skilled in the art, and the general principles defined herein may be applied to other embodiments and applications without departing from the spirit and scope of the present disclosure. Thus, the present disclosure is not limited to the embodiments shown but is to be accorded the widest scope consistent with the claims.

Figure 1B:
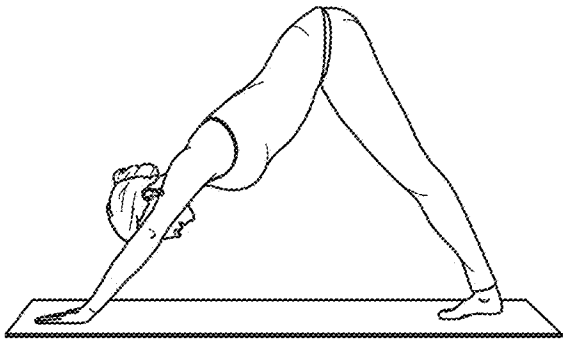
FIG. 1B is a picture of a yoga practitioner performing a downward facing dog pose.
Figure 1A:
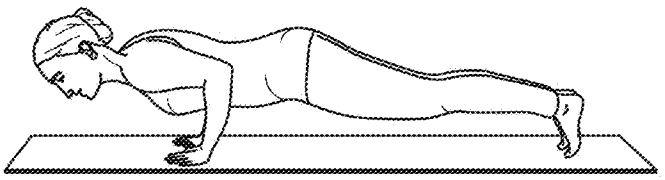
FIG. 1A is a picture of a yoga practitioner performing a plank pose.
Figure 1C:
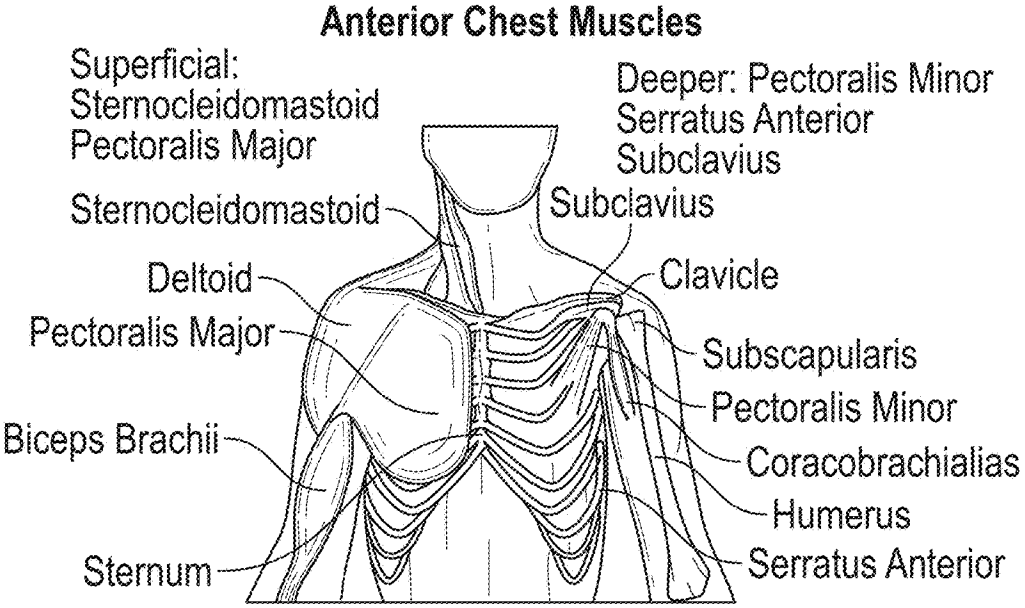
FIG. 1C is schematic diagram showing anterior chest muscles.
Figure 2A:
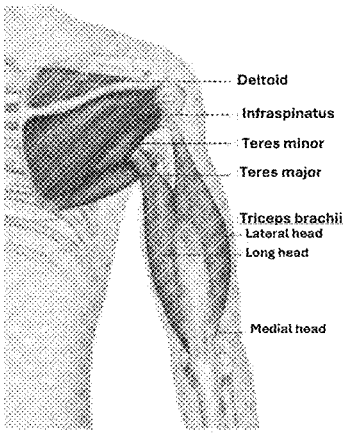
FIG. 2A is schematic diagram showing rotator cuff muscle.
Figure 2B:
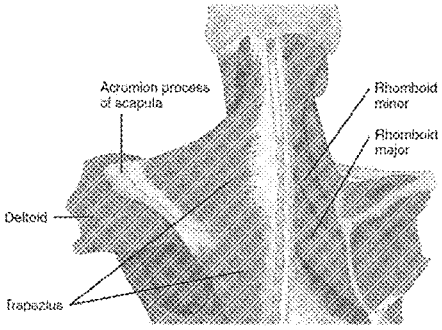
FIG. 2B is schematic diagram showing the rhomboids, the traps, the mid traps, low traps.

Many yoga practitioners lack strength outside of traditional yoga postures, demonstrating strength in movements like push-ups and planks, but weakness in movements that require pulling, such as rows and deadlifts. Referring to FIGS. 1A and 1B, two very common yoga poses: plank, and downward facing dog, are respectively shown. These common yoga poses strengthen the front muscles such as the anterior muscles shown in FIG. 1C. Posterior chain muscles such as those shown in FIGS. 2A and 2B however, are not activated or strengthened. Over time, many yoga practitioners may develop muscle imbalances when one muscle group overpowers another. Because forces coupled in the body cannot function properly when one muscle group overpowers another, these muscle imbalances in yoga practitioners may lead to injuries.

Figure 3A:
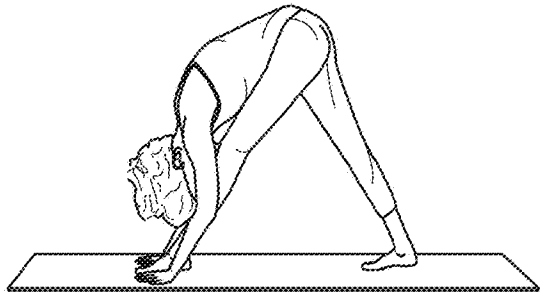
FIG. 3A is a picture of a yoga practitioner performing a triangle pose.
Figure 3B:
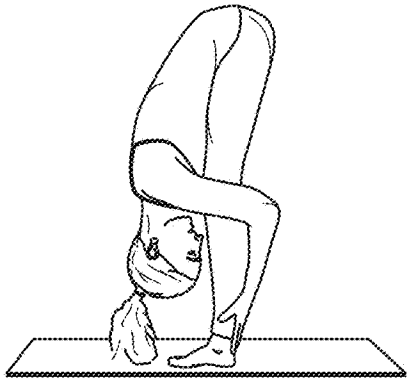
FIG. 3B is a picture of a yoga practitioner performing a forward bend pose.
Figure 3C:
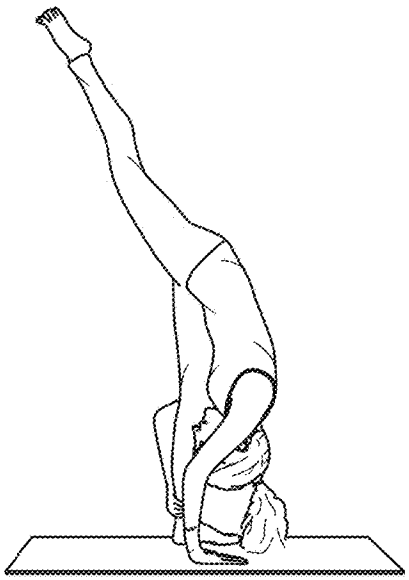
FIG. 3C is a picture of a yoga practitioner performing another yoga pose.
Figure 3D:
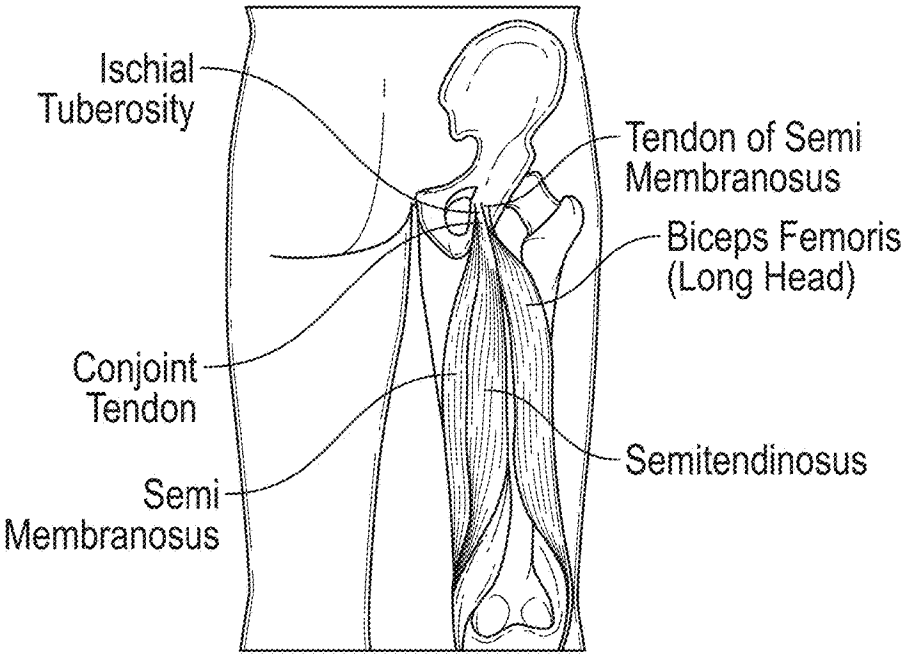
FIG. 3D is schematic diagram showing hamstring muscle.

Additionally, overstretching the back body muscles and under strengthening them is also common in yoga exercises. For example, FIGS. 3A-3C are showing a triangle pose, forward bend pose, and other poses that stretch back body muscles such as hamstring without providing much strengthening of those muscles. Pain at the ischium tuberosity therefore can develop and is more commonly referred to as the yoga butt, as shown in FIG. 3D.

Much of the pulling movements in strength training are difficult to accomplish using a practitioner's body weight alone, without equipment such as a dumbbell or resistance band. Using dumbbells in yoga classes, however, can be awkward when a practitioner has to reach down and pick up a dumbbell, then set it back down, which interferes with the flow that a yoga practitioner experiences.

Figure 4:
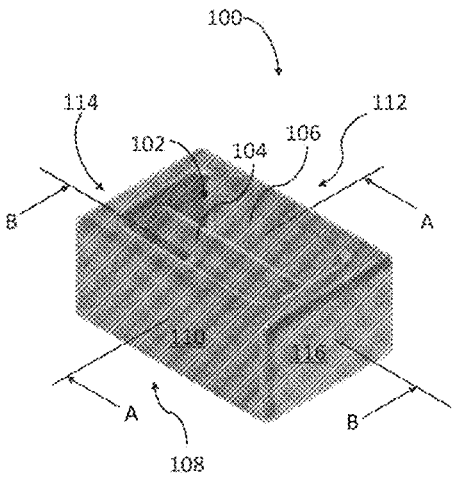
FIG. 4 is three-dimensional perspective view of a weighted block according to some embodiments of the present disclosure.

Disclosed herein is a weighted block that can function both as a support for body weight and a weight for strength training during a yoga exercise. The weighted block can be used to allow a yoga participant to move in and out of poses without picking up and setting down weights. As shown in FIG. 4, a weighted block having a hexahedron shaped block body 100 comprises a cavity 102 and a handle 104 inside the cavity so that it can be used as a weight during a strength training. The block 100 additionally has the physical integrity to be used as a support for body weight when performing yoga poses.

Figure 5B:
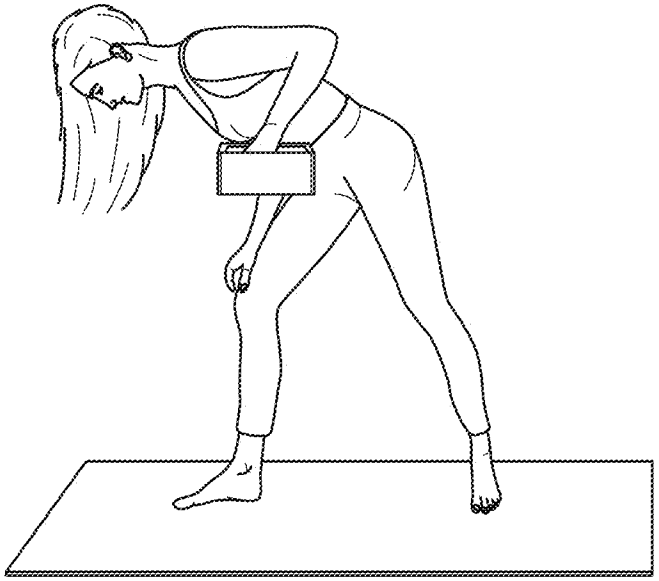
FIG. 5B is a picture illustrating the yoga practitioner of FIG. 5A using the weighted block as a weight in a rowing exercise.
Figure 5A:
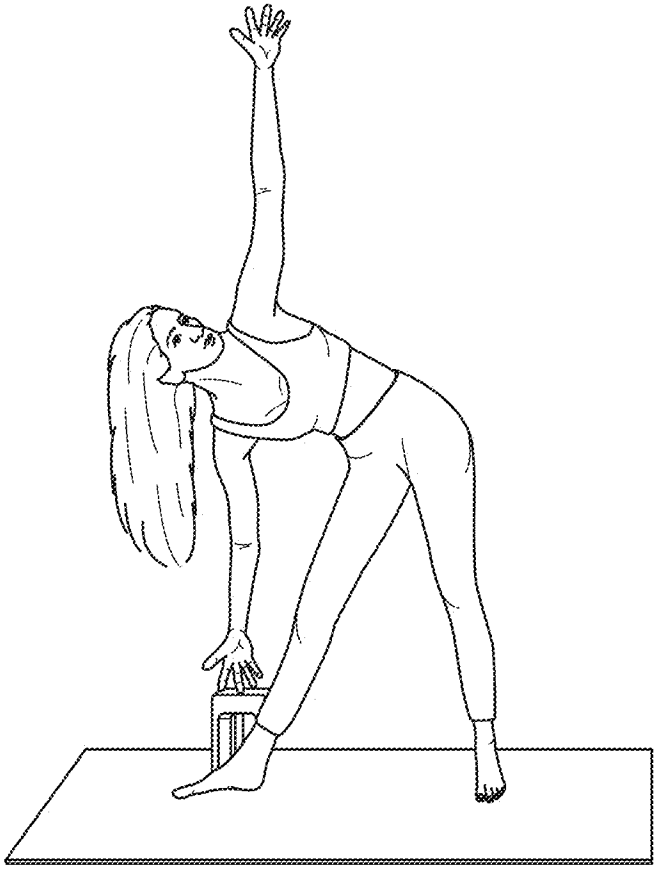
FIG. 5A is a picture illustrating a yoga practitioner using the weighted block disclosed herein as a support for body weight.
Figure 5C:
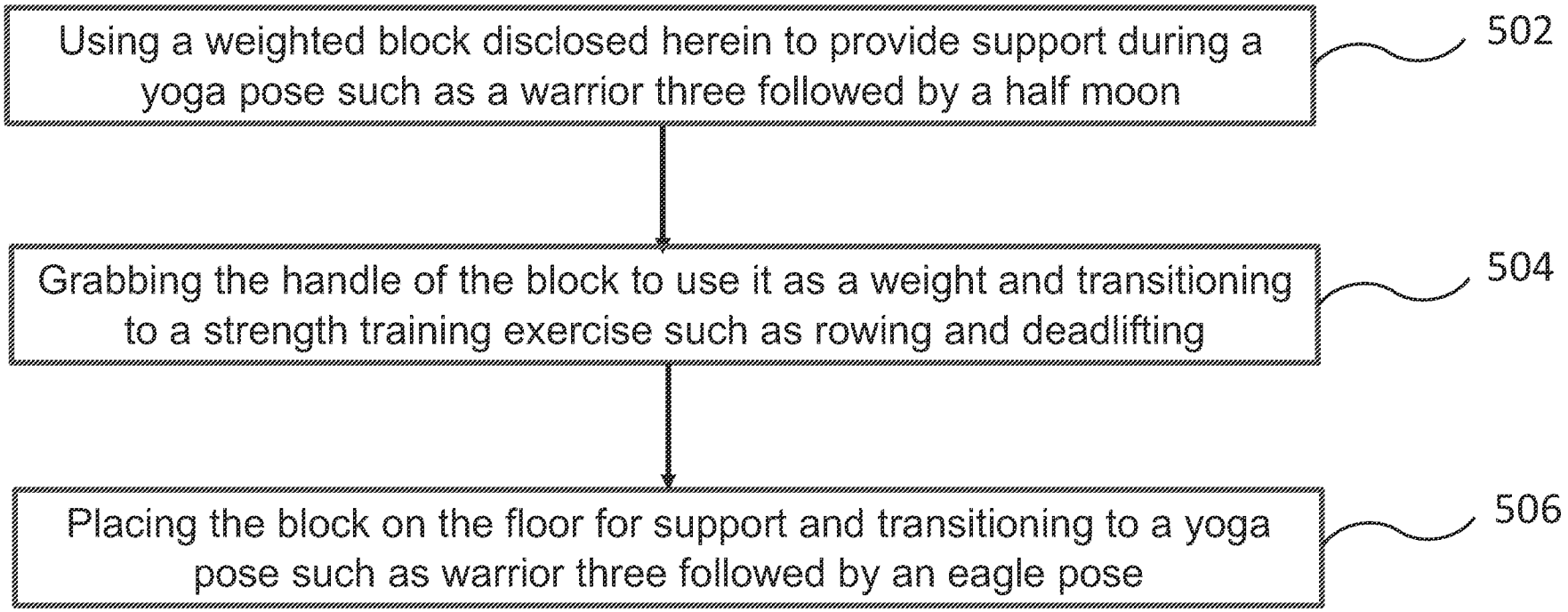
FIG. 5C is a flow chart illustrating a yoga sequence balanced with strength training using a weighted block according to one embodiment of the instant disclosure.
Figure 6:
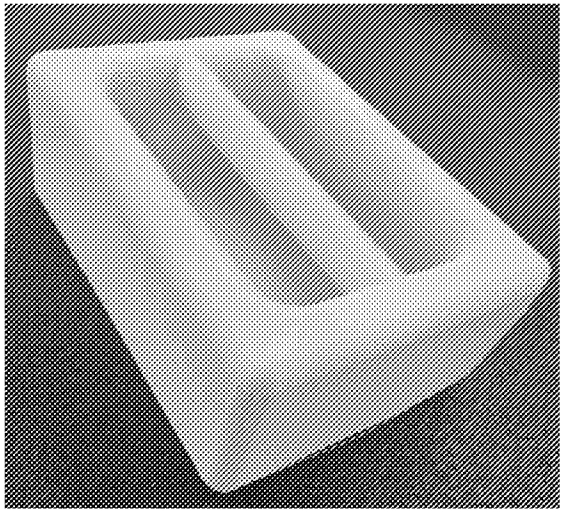
FIG. 6 is a top perspective view of a weighted block according to some embodiments of the present disclosure.
Figure 7:
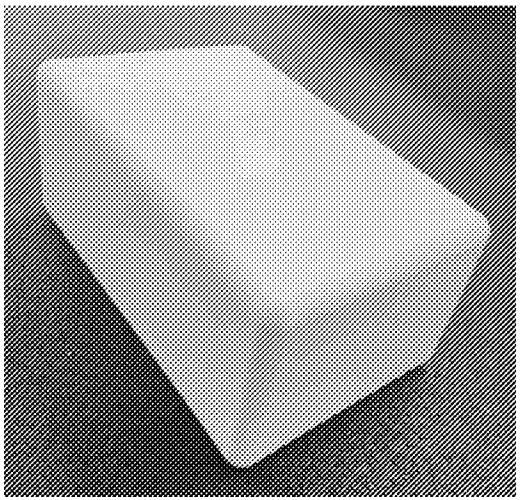
FIG. 7 is a bottom perspective view of the weighted block of FIG. 6.
Figure 8:
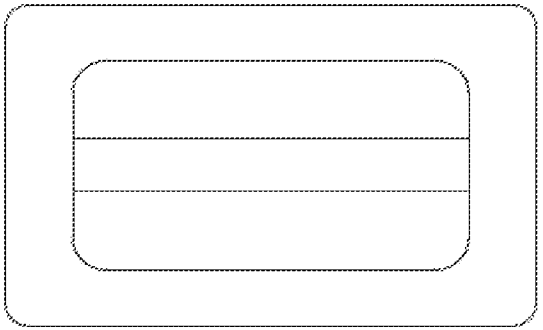
FIG. 8 is a top view of the weighted block of FIG. 6.
Figure 9:
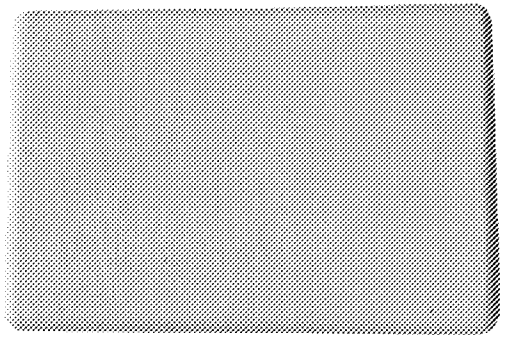
FIG. 9 is a bottom view of the weighted block of FIG. 6.
Figure 11:
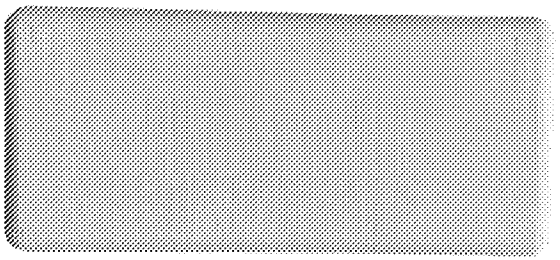
FIG. 11 is a back view of the weighted block of FIG. 6.
Figure 13:
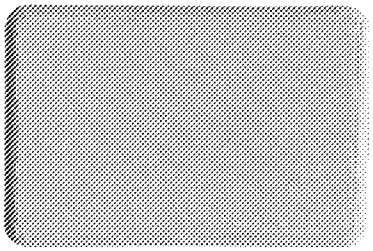
FIG. 13 is a right view of the weighted block of FIG. 6.
Figure 10:
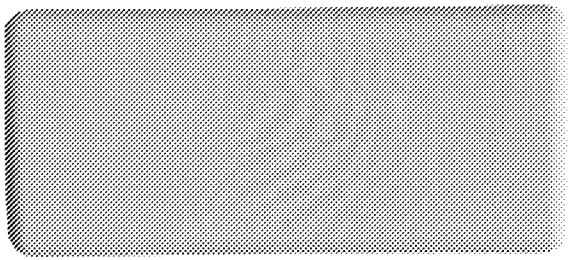
FIG. 10 is a front view of the weighted block of FIG. 6.
Figure 12:
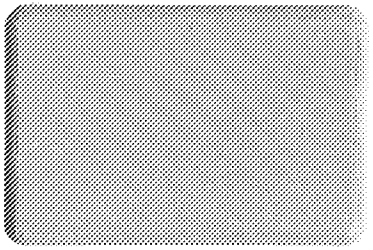
FIG. 12 is a left view of the weighted block of FIG. 6.

For example, if a practitioner is using the weighted block disclosed herein as a support in a triangle pose as shown in FIG. 5A, she or he could then reach and grab the handle to pick up the block to use it as a weight to perform rowing exercises that strengthen her upper back as show in FIG. 5B. Referring to FIG. 5C, a flow chart illustrating a yoga sequence balanced with strength training is shown. According to process shown in FIG. 5C, a weighted block disclosed herein is first used by a yoga practitioner to provide support during a yoga pose such as a warrior three followed by a half moon in step 502. The yoga practitioner then grabs the handle of the block to use it as a weight and transition to a strength training exercise such as rowing and deadlifting in step 504.

The strength training exercise is believed to balance the yoga poses and provide much needed strengthening of the posterior chain muscles, such as the hamstrings and rhomboids. After the strength training exercise, the yoga practitioner can optionally place the block back on the floor to provide support for subsequent yoga poses such as warrior three followed by an eagle pose in step 506.

The present disclosure describes a weighed block, referred to herein as a "Bili Block," to be used as a weight for strength training and also a body weight support. As shown in FIG. 4, the Bili Block has a hexahedron shaped weighted block body 100 with a cavity 102, and a handle 104. The block body 100 also includes a top opening 106 to the cavity 102, a bottom wall 108 opposite to the top opening 106, a front wall 110 opposite to a back wall 112, and a left wall 114 opposite to a right wall 116. The bottom 108, front 110, back 112, left 114, and right 116 walls are interconnected and surround the cavity 102 to form the hexahedron shaped block body 100. The handle 104 inside the cavity 102 is connected to the left 114 and right 116 walls.

While the handle 104 is visible through the top opening 106, the handle 104 is not visible from a bottom side of the block body 100. That is, the bottom wall 108 encloses the bottom side of the block body 110. Thus, from the bottom side, the block body 100 still functions as a typical yoga block and maintains the aesthetic appearance of a typical yoga block. The handle 104 also permits a yoga practitioner to grab and grip the block body 100 and perform rowing motions, bilateral rowing movements, and other muscle strengthening exercises.

The handle 104 has a diameter selected such that practitioners with smaller and larger hands can grip the block in the same manner and comfort that a dumbbell can be gripped. Additionally, the handle 104 is uniquely positioned and structured within the cavity 102 such that all yoga practitioners, from those with very small hands to those with very large hands, can comfortably grip the block body 100 and comfortably perform yoga exercises.

At least one of the handle 104, the bottom wall 108, the front wall 110, the back wall 112, the left wall 114 and the right wall 116 comprises a material such that the block body 100 has a weight of at least 0.5 pound. For example, one embodiment could be in a range of around 0.5-50 lbs. In one example, a yoga studio may have sets of the Bili Block, where individual blocks within a set will have different weights. However, the Bili Block is designed such that blocks of different weights may have the same physical dimensions. That is, blocks of different weights will be formed of materials with slightly different compositions and consistencies such that blocks with the same physical dimensions can have different weights.

Figure 4A:
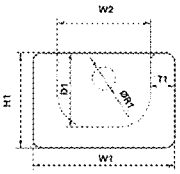
FIG. 4A is a cross sectional view of the weighted block of FIG. 4 along the A-A line.
Figure 4B:
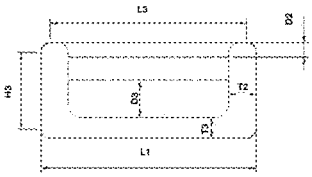
FIG. 4B is a cross sectional view of the weighted block of FIG. 4 along the B-B line.
Figure 4C:
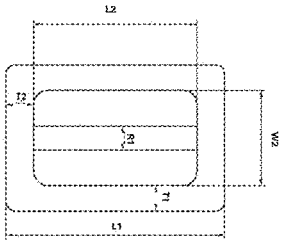
FIG. 4C is a top view of the weighted block of FIG. 4.

The cross-sectional views of the block body 100 are shown in FIG. 4A and FIG. 4B along the A-A and B-B lines, respectively. The top view of the block body 100 is shown in FIG. 4C. As shown in FIGS. 4A and 4B, the block body 100 has a height H1, a length L1 and a width W1. In general, the length L1 of the block body 100 is greater than the width W1.

For example, the length L1 of the block body 100 can be within a range of around 190-280 millimeters (mms). In one embodiment, and by way of example only and not limitation, the length L1 of the block body 100 can be about 229 mm. The width W1 of the block body 100 can be within a range of 125-185 mms. The height H1 of the block body 100 can be within a range of about 85-125 mms.

The position of the handle 104 and the thickness of the walls of the block body 100 are designed such that during use, the block body 100 maintains its integrity when a body weight of a practitioner is applied to one of the handle 104, front 110, back 112, right 116, and left 114 walls when its respective opposite wall is positioned against an immobile surface such as a floor. The walls of the block body 100 therefore are constructed with enough thickness and strength to such integrity.

As shown in FIG. 4A and FIG. 4B, in some embodiments, the bottom 108 wall can have a thickness T3 within a range of about 18-26 mm. In one exemplary embodiment, the thickness T3 of the bottom wall 108 can be around 22 mm. In the embodiments, the left wall 114 and right wall 116 can have a thickness T2 within a range of around 24-35 mms. Similarly, the front wall 110 and back wall 112 can have a thickness T2 within a range of around 22-32 mms.

As shown in FIGS. 4A, in general, the cavity 102 has a depth D1 measured from the top opening 106 to the bottom wall 108. As shown in FIG. 4C, the cavity 102 has a length L2 measured from left wall 114 to the right wall 116 and a width W2 measured from the front wall 110 to the back wall 112. In general, the length L2 of the cavity 102 is greater than its width W2. For example, the length L2 of the cavity 102 can be within a range of about 140-205 mms. In the embodiments, the width W2 of the cavity 102 can be within a range of about 80-120 mms. The depth D1 of the cavity 102 can be within a range of about 65-100 mms.

As shown in FIG. 4A and FIG. 4B, the handle 104 is positioned in equal distance from the front wall 110 and back wall 112. As shown in FIG. 4B, the handle 104 is positioned inside the cavity 102 and having a depth D2 below the top opening 106, closer to the top opening 106 than to the bottom wall 108. In some embodiments, the depth D2 of the handle 104 can be within a range of around 3-25 mms. In the embodiments, the handle 104 is a rod that can be cylindrical in shape having a cross section with a diameter R1 within a range of around 15-35 mms.

As shown in FIG. 4B, the handle 104 is positioned inside the cavity 102 and having a depth D3 between the handle 104 and the bottom wall 108. In some embodiments, the depth D3 of the handle 104 can be within a range of around 25-55 mms. In the embodiments, the handle 104 is above the midpoint between the top opening 106 and the bottom wall 108.

Figure 14:
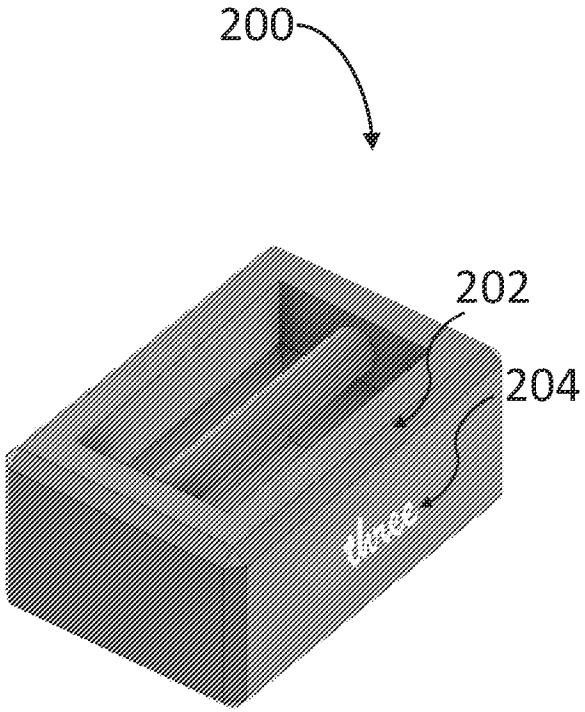
FIG. 14 is three-dimensional perspective view of a weighted block according to some embodiments of the present disclosure having beveled edges.

As shown in FIGS. 4A-4C, in some embodiments, the hexahedron block body 100 comprises rounded end vertices. As shown in FIG. 4A and FIG. 4B, in some embodiments, the block body 100 has a U-shaped cross section. As shown in FIG. 14, in some embodiments, the hexahedron block body 100 comprises beveled edges 202 and vertices. The block body 100 described herein can further comprise markings (e.g., indicating weight) on any of the left wall 114, right wall 116, front wall 110 and back wall 112.

In one embodiment, as shown in FIG. 14, the marking 204 is positioned on an exterior surface of a block body 200. For example, the marking 204 can be on the exterior surface of one or more of the left wall, right wall, front wall, and back wall. In the illustration of FIG. 14, the marking 204, indicating the weight, is written in a non-Arabic form. For example, the marking 204 may be written in cursive on one or more of the walls in cursive. Having the weight marking 204 written in a non-Arabic form (written out as words, as opposed to Arabic or Roman numerals) may be more neurologically, subconsciously, or subliminally consistent with the mind body aesthetic vibe of yoga studios.

The dimensional data of the block body 100 outlined above including the degree of roundness or bevel in the edges or vertices can be generated by a computer and used in a three-dimensional (3D) software such that the block body 100 can be printed based on the dimensional data with thermoplastic material to form the weighted block body 100. Thermoplastic used in 3D printing include ABS (acrylonitrile butadiene styrene), PLA (polylactic acid), HIPS (high impact polystyrene), Nylon 618, Nylon 645, Nylon 680, Nylon 910, PP (polypropylene), PT (polyethylene terephthalate), LayBrick (finely crushed chalk and other minerals suspended in a thermoplastic resin), or LayWood (fine wood particles are suspended in a thermoplastic resin). In one embodiment, the thermoplastic is ABS. In another embodiment the thermoplastic is PLA. In some embodiments, the 3D printed block body 100 can be further coated with other materials to provide a smooth and durable surface. For example, the 3D printed block body 100 can be coated silicon, rubber, or a similar polymeric material.

Alternatively, metal can be used to produce a mold based on the dimensional data outlined above, which can be further coated with other materials to provide a smooth and durable surface. For example, the metal mold of the weighted block body 100 can be coated with silicon. In one embodiment, the metal used to produce the mold is stainless steel. In one embodiment, the metal used to produce the mold is an alloy. Cement/concrete or similar materials may also be used.

In some embodiments, the handle 104 portion of the block body 100 is made of a material that is different from the material used for the walls of the block body 100. In one embodiment, the handle 104 contributes most of the weight of the block body 100. In some embodiments, the handle 104 contributes to at least 50% of the weight of the block body 100. In other embodiments, the handle 104 contributes to about 50%-95 of the weight of the block body 100.

In some embodiments, the walls of the block body 100 are made of a material that is different from the material used for the handle 104. In other embodiments, the walls can contribute to 50%-90% of the weight of the block body 100. In yet other embodiments, the walls and handle of the block body 100 can be formed of an exterior shell of one material (e.g., plastic) that is filled with a different material or substance (e.g., water).

An ornamental design of an embodiment of a weighted block body 100 of the present disclosure viewed from different directions/perspectives are shown in FIGS. 6-13. The weighted block body 100 as shown in FIGS. 6-13 is not limited to the scale shown. As indicated in the title, the article of manufacture to which the ornamental design has been applied is a weighted block body 100.

The embodiments above are intended to be illustrative and not limiting. Additional embodiments are within the claims. In addition, although the present disclosure has been described with reference to particular embodiments, those skilled in the art will recognize that changes can be made in form and detail without departing from the spirit and scope of the disclosure. Any incorporation by reference of documents above is limited such that no subject matter is incorporated that is contrary to the explicit disclosure herein.

I claim:

1. One or more weighted blocks, each weighted block comprising, a hexahedron shaped block body having:

a cavity;

a top opening to the cavity;

a bottom wall opposite to the top opening;

a front wall opposite to a back wall;

a left wall opposite to a right wall, with the bottom, front, back, right, and left walls being interconnected and surrounding the cavity to form the hexahedron shaped block body;

a rod inside the cavity connecting the left and right walls;

wherein the cavity has a depth measured from the top opening to the bottom wall, a length measured from left wall to the right wall, and a width measured from the front wall to the back wall;

wherein the block body maintains its integrity when a weight or force is applied to one of the bottom, front, back, right, and left walls when its respective opposite top opening, back, front, left, or wall is positioned against an immobile surface;

wherein the bottom, front, back, right, and left walls are substantially flat; and wherein the one or more weighted blocks includes two or more weighted blocks having (i) weights that are different from each other and (ii) physical dimensions that are equal to each other.

2. The one or more weighted blocks of claim 1, wherein each weighted block has a weight between 1-35 lb, and wherein each of the bottom, front, back, right, and left walls has a thickness of more than 1 mm.

3. The one or more weighted blocks of claim 1, wherein each weighted block has a weight of 3, 5, or 10 lb.

4. The one or more weighted blocks of claim 1, wherein each weighted block has a length between 190-280 mm, a width between 125-185 mm, and a height between 85-125 mm.

5. The one or more weighted blocks of claim 1, wherein the bottom wall has a thickness between 18-26 mm, the left or right wall has a thickness between 24-35 mm, and the front or back wall has a thickness between 22-32 mm.

6. The one or more weighted blocks of claim 1, wherein the cavity has a length between 140-205 mm, a width between 80-120 mm, and a depth between 65-100 mm.

7. The one or more weighted blocks of claim 1, wherein the rod is positioned in equal distance from the front and back walls.

8. The one or more weighted blocks of claim 1, wherein the rod is positioned inside the cavity, between 3 mm-25 mm below the top opening, and between 25 mm-55 mm above the bottom wall.

9. The one or more weighted blocks of claim 1, wherein the rod is cylindrical in shape having a circular cross section that has a diameter between 15-35 mm.

10. The one or more weighted blocks of claim 1, wherein the rod is positioned above the midpoint of the depth of the cavity and is cylindrical in shape, having a circular cross section that has a diameter between 20-30 mm.

11. The one or more weighted blocks of claim 1, wherein the hexahedron shaped block body comprises rounded or beveled edges and vertices.

12. The one or more weighted blocks of claim 1, wherein each weighted block has a U-shaped cross section.

13. The one or more weighted blocks of claim 1, wherein the material of each weighted block is metal or metal alloy, which is further covered by a polymeric material.

14. The one or more weighted blocks of claim 13, wherein the polymeric material of each weighted block is silicon.

15. The one or more weighted blocks of claim 1, wherein two or more of the one or more weighted blocks represent a set of weighted blocks, and wherein the weighted blocks having different weights are formed of materials having different densities.

16. A method of making one or more weighted blocks of claim 1, the method comprising:

providing dimensional data of the one or more weighted blocks to a 3D printer, and printing the one or more weighted blocks based on the dimensional data with thermoplastic to form the one or more weighted blocks.

17. A method of making one or more weighted blocks, the method comprising;

forming a metal or metal alloy mold using dimensional data of the one or more weighted blocks of claim 1, and coating the mold with silicon to form the one or more weighted blocks.

18. A method of using one or more weighted blocks to strengthen posterior chain muscle(s) during a yoga session, each weighted block comprising:

a hexahedron shaped block body having a cavity;

a top opening to the cavity;

a bottom wall opposite to the top opening;

a front wall opposite to a back wall; and a left wall opposite to a right wall, with the bottom, front, back, right, and left walls interconnected and surrounding the cavity to form the hexahedron shaped block body; and a rod inside the cavity connecting the left and right walls;

wherein the cavity has a depth measured from the top opening to the bottom wall, a length measured from left wall to the right wall, and a width measured from the front wall to the back wall; and wherein the one or more weighted blocks includes two or more weighted blocks having (i) weights that are different from each other and (ii) physical dimensions that are equal to each other;

wherein the block body maintains its integrity when a weight or force is applied to one of the bottom, front, back, right, and left walls when its respective opposite top opening, back, front, left, or wall is positioned against an immobile surface; and wherein the bottom, front, back, right, and left walls are substantially flat, and each has a thickness of more than 1 mm;

the method comprising:

holding the rod inside the cavity of the one or more weighted blocks as a weight to perform an exercise to strengthen posterior chain muscles during the yoga session.

19. The method of claim 18, further comprising placing one of the top opening, front, back, left, or right walls of the block on the floor, and applying body weight on a respective opposite wall of the bottom, front, back, left, or right wall of the one or more weighted blocks to provide support during a yoga pose.

20. The method of claim 18, wherein the exercise includes at least one of rowing, deadlifting.

21. The method of claim 18, wherein the posterior chain muscle includes hamstring, glutes, rotator cuff muscle, rhomboids, mid traps, low traps.

22. A yoga balancing system formed of two or more weighted blocks, each weighted block comprising, a hexahedron shaped block body having:

a cavity;

a top opening to the cavity;

a bottom wall opposite to the top opening;

a front wall opposite to a back wall;

a left wall opposite to a right wall, with the bottom, front, back, right, and left walls interconnected and surrounding the cavity to form the hexahedron shaped block body; and a rod inside the cavity connecting the left and right walls;

wherein the cavity has a depth measured from the top opening to the bottom wall, a length measured from left wall to the right wall, and a width measured from the front wall to the back wall;

wherein the hexahedron shaped block body maintains its integrity when a weight or force is applied to one of the bottom, front, back, right, and left walls when its respective opposite top opening, back, front, left, or wall is positioned against an immobile surface;

wherein the bottom, front, back, right, and left walls are substantially flat; and wherein the two or more blocks (i) have weights that are different from each other (ii) have physical dimensions that are equal to each other and (iii) are constructed of materials having different densities.

* * * * *